US005558759A

United States Patent [19]

Pudem

[11] Patent Number: 5,558,759

[45] Date of Patent: Sep. 24, 1996

[54] METAL FINISHING PROCESS

[75] Inventor: Roger Pudem, Clinton, Conn.

[73] Assignee: Sargent Manufacturing Company, New Haven, Conn.

[21] Appl. No.: 280,725

[22] Filed: Jul. 26, 1994

[51] Int. Cl.[6] ..... C25D 7/00; C25D 5/10; C25D 5/34; C25D 5/48

[52] U.S. Cl. ..... 205/50; 205/176; 205/182; 205/205; 205/206; 205/210; 205/220; 205/222; 428/935

[58] Field of Search ..... 205/170, 176, 205/182, 205, 206, 210, 220, 222; 427/328, 405, 409, 410; 428/935

[56] References Cited

U.S. PATENT DOCUMENTS

| | | | |
|---|---|---|---|
| 2,516,986 | 8/1950 | Heinse | 41/18 |
| 2,657,176 | 10/1953 | Berman et al. | 204/40 |
| 2,938,841 | 5/1960 | Dale | 204/32 |
| 3,284,324 | 11/1966 | Appel et al. | 204/38 |
| 3,315,350 | 4/1967 | Kent | 29/529 |
| 3,317,411 | 5/1967 | Letendre | 204/29 |
| 3,645,857 | 2/1972 | Fisher et al. | 204/28 |
| 3,664,933 | 5/1972 | Clauss | 204/38 |
| 3,716,462 | 2/1973 | Jensen | 204/38 |
| 3,767,538 | 10/1973 | Politycki et al. | 204/30 |
| 3,887,449 | 6/1975 | Baer | 204/148 |
| 3,928,147 | 12/1975 | Kowaiski | 204/29 |
| 3,930,807 | 1/1976 | Kobayashi et al. | 29/195 |
| 3,954,574 | 5/1976 | Gyllenspetz et al. | 204/43 |
| 3,957,452 | 5/1976 | Schaer et al. | 29/183 |
| 3,991,526 | 11/1976 | Frank et al. | 51/358 |
| 4,022,585 | 5/1977 | Kaye | 428/551 |
| 4,054,494 | 10/1977 | Gyllenspetz et al. | 204/43 |
| 4,157,941 | 6/1979 | Donakowski | 428/652 |
| 4,272,570 | 6/1981 | Narayan | 427/436 |
| 4,273,837 | 6/1981 | Coll-Palagos | 428/647 |
| 4,287,041 | 9/1981 | Tominaga et al. | 204/181 |
| 4,436,595 | 3/1984 | Matson | 204/40 |
| 4,599,279 | 7/1986 | Mirra et al. | 428/658 |
| 4,715,116 | 12/1987 | Thorpe et al. | 29/846 |
| 5,006,207 | 4/1991 | Peterman et al. | 204/18.1 |
| 5,108,554 | 4/1992 | Deters | 205/145 |

FOREIGN PATENT DOCUMENTS 494419 7/1953 Canada .

OTHER PUBLICATIONS

DeLong, "Electroplating Magnesuim and Its Alloys", Metal Finishing, vol. 46, No. 7 (1948), pp. 46–49, 100 (no month).

*Primary Examiner*—Kathryn Gorgos
*Assistant Examiner*—Edna Wong
*Attorney, Agent, or Firm*—DeLio & Peterson

[57] ABSTRACT

A finishing process for a base metal substrate comprising the steps of polishing the surface of the base metal substrate, electroplating the metal substrate with copper, electroplating a layer of metal over the copper plate, and depositing a substantially moisture impervious coating on the metal layer.

23 Claims, No Drawings

METAL FINISHING PROCESS

BACKGROUND OF THE INVENTION

1. Field of the Invention

The present invention pertains to a metal finishing process and more particularly, to a metal finishing process which prevents the chemical reactions known as "leakout" and "outgassing".

2. Problem to be Solved

Zinc die casting are widely used for the production of commodities including plumbing fixtures, door handles, toys and automotive parts. It has been found that when the adhesion between a zinc die cast component and a brass or bronze electroplate is insufficient, reactions known as "leakout" and "outgassing" occur.

Outgassing is the escape of atmospheric gases, such as air, trapped in the pores of the zinc substrate, between the substrate and the plating, and within the pores of the plating. The gases typically escape during the curing process of the powdered coating which is applied to the final plated surface. As the component is heated to cure the powdered coating, the gases escape from the pores in the substrate through the pores in the plating and emerge into the atmosphere. Outgassing manifests itself as bubbles in the clear powder coating formed by the penetration of the gases in the powder coating as the powder coating cures.

Leakout is a discoloration on the surface of the electroplating and is caused by chemicals, such as cyanide, entrapped in the pores of the plated surface that react with atmospheric moisture. Leakout results in a dark discoloration of the electroplate. Leakout is especially prevalent in brass or bronze plated substrates because the brass and bronze plating processes are typically available in a cyanide chemistry.

One conventional method requires application of lacquer to the electroplate surface. However, it has been found that lacquer does not offer an adequate moisture barrier to prevent leakout and outgassing.

Therefore, it is an object of the invention to provide a new and improved metal finishing process that prevents the chemical reaction known as leakout.

It is another object of the present invention to provide a new and improved metal finishing process that prevents the chemical reaction known as outgassing.

It is another object of the present invention to provide a new and improved metal finishing process for electroplating base metal substrates with brass or bronze that prevents the chemical reaction known as leakout.

It is another object of the present invention to provide a new and improved metal finishing process for electroplating base metal substrates with brass or bronze that prevents the chemical reaction known as outgassing.

It is a further object of the invention to provide a new and improved zinc die cast component electroplated with brass or bronze that does not exhibit the chemical reaction known as leakout.

It is a further object of the invention to provide a new and improved zinc die cast component electroplated with brass or bronze that does not exhibit the chemical reaction known as outgassing.

It is a feature of the invention to polish and buff the surface of the base metal substrate to substantially remove coarse surfaces, pores, cavities and minor indentations.

A further feature of the present invention to is electroplate a copper layer over the substrate surface to provide a substantially uniform surface upon which is plated a layer of brass or bronze.

It is another feature of the invention to electrostatically apply a clear epoxy coating to the final electroplated surface of the component.

An advantage of the present invention is improved adhesion between the base metal substrate and the copper plating which inhibits the occurrence of leakout and outgassing when the temperature of the substrate is elevated.

SUMMARY OF THE INVENTION

The present invention is directed to a process for preparing and electroplating a base metal substrate which produces sufficient adhesion between the substrate and a brass or bronze plating to prevent the occurrence of chemical reactions known as leakout and outgassing. The prevention of outgassing and leakout at elevated temperatures allows the application of a clear coating to the brass or bronze plating which further inhibits the aforementioned chemical reactions.

In one aspect, the present invention is directed to a process for providing a "satin" finish on zinc-die cast components which basically comprises the steps of polishing the surface of the zinc die cast component, electroplating the zinc-die cast component with copper, polishing the copper layer by removing any roughness and also any non-adherent film left on the surface of the copper, electroplating a layer of 30 bronze or brass over the copper layer and depositing a substantially moisture impervious clear coating on the brass or bronze plate.

In a related aspect, the present invention is directed to a process for providing a "bright" finish on a zinc cast component which basically comprises the steps of polishing the surface of the zinc die cast component, electroplating the zinc-die cast component with copper, polishing the copper layer by removing any roughness and also any non-adherent film left on the surface of the copper, removing any residue left on the copper surface by the aforementioned polishing step using a solvent such as trichloroethylene in a vapor degreaser, electroplating a layer of brass or bronze over the copper layer and depositing a substantially moisture impervious clear coating on the brass or bronze plating.

In related aspects, the present invention is directed to zinc die cast components made in accordance with the processes described above.

In a further aspect, the present invention is related to an article comprising a base metal substrate, a copper layer plated on the substrate, a layer of metal plated over the copper layer selected from the group consisting of brass or bronze, and a substantially moisture impervious clear coating disposed over the metal layer.

DESCRIPTION OF THE PREFERRED EMBODIMENTS

1. Definitions

As used herein, the term "polishing" is defined to be an operation in which coarse scratches or, in some instances, rough surfaces in the substrate surface left after forging, rolling or similar operations, are substantially removed to produce a substrate surface texture commensurate with a predetermined scratch pattern. Preferably, the 5 polishing operation is implemented with an abrasive belt and a contact wheel, and the component to be polished is handheld and applied against the contact wheel so the abrasive characteristics of the belt remove any material and imperfections in the component surface.

As used herein, the phrase "grain size" is defined to be the size of the grains on a particular abrasive belt. "Grain size" is also known in the art as "grit size". The following grain sizes are referred to throughout the description of the present invention: (a) 100 (fine), (b) 150 (fine), (c) 180 (fine), (d) 200 (very fine), (e) 220 (very fine). The terms "fine" and "very fine" are used to generally describe the degree of coarseness of the grains or grit on an abrasive belt. The polishing processes described herein utilize abrasive belts having 100, 150 and 180 grain sizes.

As used herein, the phrase "scratch pattern" is defined to be the surface texture of the component or plating that results from polishing, refining or buffing the surface with an abrasive belt having a specific grain size. For instance, a #120 scratch pattern (or scratch pattern of 120) results on the component or plating surface when the surface is polished with an abrasive belt having a grain size of 120.

As used herein, the terms "buffing" or "refining" are defined to be finish polishing processes whereby abrasive belts having successively finer grain or grit sizes are applied to the component surface or plating surface so that coarse scratch patterns are transformed into fine or very fine scratch patterns. Very little material is removed from the component surface or plating surface during the buffing or refining steps. The buffing or refining processes described herein utilize abrasive belts having grain sizes of 200 and 220.

2. Satin Finish

The process for producing a "satin" finish on a zinc die cast component that is electroplated with bronze comprises the steps of: (a) providing a zinc-die cast component, (b) polishing the component surface until the surface is commensurate with a first scratch pattern, (c) polishing the contoured surface of the component until the contoured surface is commensurate with a second scratch pattern, (d) polishing the component surface until the surface is commensurate with the second scratch pattern, (e) scouring the component, (f) electroplating the component with copper, (g) scouring the component, (h) electroplating a layer of brass or bronze over the copper layer, (i) scouring the component, and (j) depositing a moisture impervious clear coating on the plated component. Each of these steps will now be described in detail.

Step (a) requires providing a zinc die cast component. Zinc alloys are particularly suited for making zinc die castings since the melting point is reasonably low, resulting in long die life even with ordinary steels. Furthermore, zinc die castings 5 fabricated from zinc alloys produce component surfaces that are suited for polishing and other finishing processes. However, the processes of the present invention may be used with other castable ferrous; metal substrates such as cold-roll steel or steel forging.

The polishing process of step (b) entails polishing the zinc-die casting component so as to remove major defects, such as parting lines, on the surface of the component. A #120 grain or grit size polishing belt having an aluminum oxide abrasive and X-flex backing, and a serrated rubber contact wheel are utilized for this process. The contact wheel has a hardness of about 70 durometers, an outer diameter of about fourteen (14) inches and an operating speed of about 1750 revolutions per minute (r.p.m.). Step (b) effects a zinc-die cast component surface texture that is commensurate with a scratch pattern of 120.

The polishing process of step, (c) entails polishing the component in the areas defined by intricate contours that are difficult to reach during the polishing process of step (b). Such intricate surface contours are typically found on door-lever handles. A #150 grain or grit size polishing belt having an aluminum oxide abrasive with X-flex backing is utilized in conjunction with a Bader polishing machine. It is preferred that the Bader polishing machine be used with a heavy duty B.J.Y attachment arm without a platen. Step (c) effects a zinc-die cast component having contoured surface texture that is commensurate with a scratch pattern of about 150.

The polishing process of step (d) entails further polishing the component surface so as to transform the scratch patterns, imparted by the #120 grain or grit polishing belt of step (b), to a scratch pattern commensurate with a #150 grain or grit polishing belt, and to remove any sharp edges on the component. It is preferred that a diamond crosscut contact wheel be utilized for this process. The wheel should have about a fourteen (14) inch outer diameter and an operational speed of about 1750 r.p.m. Step (d) effects a zinc-die cast component surface texture that is commensurate with a scratch pattern of about 150.

Steps (b)–(d) effect a zinc die cast component having a surface texture, including contoured surface, commensurate with a scratch pattern of about 150. A scratch pattern of 150 is visible and is an inherent design characteristic of a component having a "satin" finish. Thus, although one may polish the zinc die cast component to attain a surface texture commensurate with finer scratch patterns, e.g. 180, 200 or 220, it is preferred to implement steps (b)–(d) to effect a component surface texture commensurate with a scratch patterns of about 150.

The scouring process of step (e) entails buffing or refining the surface of the component by blending polishing scratch patterns and removing torn substrate material using a loose buff made of several sections and a greaseless compound having a grain or grit size of about 200. The loose buff sections preferably have about a twelve (12) inch outer diameter and an operational speed of about 1750 r.p.m. Step(e) effects a zinc-die cast component surface texture that is commensurate with a scratch pattern between about 150 and 200.

The electroplating process of step (f) is a bright-cyanide copper plating process which comprises the steps of: (i) making the zinc-die cast component cathodic, (ii) applying an electrolytic cleaner to the zinc die cast component, (iii) rinsing the component in cold water flowing in a first direction, (iv) rinsing the component in cold water flowing in a second direction which is counter to the first direction, (v) dipping the component in acid, (vi) rinsing the component in cold water flowing in a first direction, (vii) rinsing the component in cold water flowing in a second direction which is counter to the first direction, (viii) striking the component with a coating of potassium copper cyanide, (ix) plating the component with copper, (x) treating the component to remove any cyanide residue, (xi) rinsing the component in cold water, (xii) rinsing the component in hot water, and (xiii) drying the component with a hot 30 air dryer to remove residue water from the aforementioned rinsing steps.

Preferably, the aforementioned electrolytic cleaner is Dyclene® EW manufactured by MacDermid Incorporated of Waterbury, Conn. and is utilized in step (ii) of step (f) above and in any process steps described herein which require the application of an electrolytic cleaner. Dyclene® EW is an off-white phosphate containing granular powder of medium alkalinity which is dissolved in water for anodic cleaning of zinc die castings, copper, brass, bronze (wrought or cast) and other copper alloys. Dyclene® EW may be used cathodically, but it preferred that a brief anodic cleaner should then follow. If this procedure is not possible, then it is preferred that the cathodic Dyclene® EW solution be discarded frequently in order to avoid replating the metallic soils which typically collect in an electrocleaner. When electrocleaning zinc die castings, it is preferred to enter the electrocleaning station dead. Preferably, Dyclene® EW is applied for about thirty (30) seconds and at about 125° F. Other electrolytic cleaners having substantially the same properties can also be used, such as Cleaner E-123 manufactured Hubbard-Hall Inc. of Waterbury, Conn.

Preferably, the acid bath of step (v) of step (f) above, and in any process steps described herein below which require the utilization of an acid bath, is implemented with Metex® Acid Salt M-629 manufactured by MacDermid Incorporated. Metex® Acid Salt M-629 is a water soluble dry acid powder. It is comprised of a balanced mixture of acid salts, activators, and surface active agents. Preferably, Metex® Acid Salt M-629 is applied according to the manufacturer's instructions and specifications. However, although manufacturer's instructions specify that Metex® Acid Salt M-629 is to be used at room temperature and for a duration of between about 15 seconds and 30 seconds, it is preferred that the duration of the acid bath be about 5 seconds. Other acid salt systems having substantially the same properties can also be used, such as Acid Salt W manufactured by Hubbard-Hall Inc. The acid bath activates the component surface which has previously been made passive by the electrolytic cleaner. A passive surface will not sufficiently adhere to a plated layer due to oxide residues which remain on the component surface after the electrolytic cleaner is applied.

The temperature of the cold water used in the cold water rinsing steps (vi) and (vii) of step (f) above, and in all cold water rinsing steps described herein is between about 30° F. and 50° F. The temperature of the hot water used in the hot water rinsing step (xii) of step (f) above and all hot water rinsing steps described herein is between about 150° F. to 170° F. Preferably, the temperature of the hot water is about 160° F.

Step (viii) of step (f) above requires striking the component with a thin coating or layer of potassium copper cyanide. The coating or layer of potassium copper cyanide has a thickness between about 0.0001 inch and 0.0002 inch, inclusive, and 30 forms a base having a substantially uniform surface texture which provides for strong adhesion to the copper layer which is plated over the layer of potassium copper cyanide. Preferably, Potassium Copper Cyanide Liquid manufactured by CP Chemicals, Inc. of New Jersey is used for this process. In a preferred embodiment, the potassium copper cyanide is applied at about 120° F. for about 15 seconds. Preferably, Potassium Copper Cyanide Liquid is used for all steps described herein which require striking the component with potassium copper cyanide.

Preferably, the copper plating process of step (ix) of step (f) above, and all process steps described herein which require copper plating, are implemented with Metex® Bright Cyanide Copper Plating Process No. S-3. Metex® Bright Cyanide Copper Plating Process No. S-3. provides a method of plating fine-grain, bright copper from cyanide solutions at a high rate of deposition. This process should be used in accordance with manufacturer's instructions. Preferably, this plating process is applied at about 150° F. for about 30 minutes. Preferably, this plating process is implemented in a manner such that the thickness of the resulting copper plate is between about 0.0004 inch and 0.0008 inch, inclusive. In a preferred embodiment, the thickness of the copper plate is between about 0.0005 inch and 0.0007 inch, inclusive. Preferably, the copper plate is pure and has no alloys or impurities. The copper layer also forms a barrier to prevent any atmospheric gases entrapped in substrate pores from penetrating the brass or bronze layer.

Step (x) of step (f) described above is a cyanide waste treatment process that effects the removal of excess cyanide used in the copper plating process which is trapped in small voids or pores in the copper plate. This waste treatment process is a chlorination process which actual dries the cyanide. The cyanide waste treatment process entails submerging the component in a solution comprising water and sodium hypochloride. The solution has a pH of about 10. The sodium hypochloride solution is agitated to ensure penetration of the solution into the voids and pores where the cyanide is trapped. This cyanide waste treatment process is used in all process steps described herein that require cyanide waste treatment. This cyanide waste treatment process substantially removes the entrapped cyanide thereby impeding the chemical reaction known as leakout which has been previously described herein.

The hot air dryer used in step (xiii) of step (f) above and in all process steps described herein which require a hot air dryer can be any generic hot air dryer, i.e. steam heated or electric heated. The temperature of the hot air produced by the dryer should be about 200° F.

The scouring process of step (g) entails buffing the copper electroplate by removing any roughness and any non-adherent residue film on the surface of the copper plate (resulting from step (ix) of step (f) above) by utilizing a loose buff made of several sections and a grit greaseless compound having a grain or grit size of about 200. Preferably, the loose buff has an operational rotational speed of about 750 r.p.m. and an outer diameter of about ten (10) inches.

The bronze-electroplating process of step (h) comprises the steps of: (i) applying an electrolytic cleaner to the component, (ii) rinsing the component with cold water, (iii) dipping the component in acid, (iv) rinsing the component in cold water, (v) striking the component with copper plate, (vi) electroplating the component with bronze, (vii) removing cyanide residue, (viii) rinsing the component in cold water, (ix) submerging the component in a chromate bath, (x) removing chrome residue, (xi) rinsing the component in cold water, (xii) rinsing the component in hot water and (xiii) drying component in a hot air dryer. The thickness of the copper plate effected by step (v) has a thickness between about 0.0001 inch and 0.0002 inch, inclusive. The thickness of the bronze plate effected by step (vi), has a thickness between about 0.0002 inch and 0.0004 inch, inclusive. Preferably, the bronze plate has a thickness of about 0.0003 inch. The chromate bath of step (ix) above is preferably implemented with a process known as HALLCOAT CU-BR manufactured by Hubbard-Hall Inc. Preferably, the chromate bath is used in accordance with the manufacturer's instructions and specifications. An alternate chromate bath which can also be used is MACRO Bright L-7 manufactured by MacDermid Inc. Removing chrome residue, in accordance with step (x), requires applying sodium hydrosulfite to the component to precipitate the excess chromate into metal hydroxide sludge. The application of sodium hydrosulfite also significantly reduces the possibility of harmful effects on the environment. All process steps described herein which require chromate baths and chrome removal are the same as described above.

If it is desired to electroplate the component with brass instead of bronze, then step (h) would comprise the steps of: (i) applying an electrolytic cleaner, (ii) rinsing the component in cold water, (iii) dipping the component in acid bath, (iv) rinsing the component in cold water, (v) striking the component with copper to form a copper plate, (vi) removing cyanide residue., (vii) rinsing the component in cold water, (viii) dipping the component in an acid bath, (ix) rinsing the component with cold water, (x) electroplating the component with nickel, (xi) performing a nickel "dragout" process on the nickel plate, (xii) rinsing the component with cold water, (xiii) dipping the component in an acid bath, (xiiv) rinsing the component with cold water, (xv) electroplating the component with brass, (xvi) removing cyanide residue, (xvii) rinsing the component in cold water, (xviii) dipping the component in an acid bath, (xix) rinsing the component in cold water, (xx) dipping the component in a chromate bath, (xxi) removing the chrome residue, (xxii) rinsing the component in cold water, and (xxiii) rinsing the component in hot water. The nickel electroplate is preferably implemented with Udylite® 66E Bright Nickel Process manufactured by OMI International Corporation of Michigan. Preferably, this process is implemented in accordance with manufacturer's instructions and specifications. The resulting nickel plate has a thickness between about 0.0001 inch and 0.0003 inch, inclusive. In a preferred embodiment, the nickel plate has a thickness of about 0.0002 inch. The nickel dragout process is a waste treatment procedure which requires rinsing excess nickel plating bath off the nickel plate. The excess nickel washed from the nickel plate is recovered and reused in a heated nickel plating bath. Preferably, the brass plating process is implemented with Bright High Speed Brass process manufactured by the LeaRonal Company of New York. This process is implemented in accordance with manufacturer's instructions and effects a brass electroplate thickness between about 0.00008 inch and 0.00012 inch, inclusive. In a preferred embodiment, the brass plate has a thickness of about 0.0001 inch.

The chromate bath utilized in the bronze and brass plating processes described herein provides a thin film of chromate over the brass or bronze layer which inhibits corrosion of the brass or bronze layer prior to application of the substantially moisture impervious clear coating.

The scouring process of step (i) entails buffing the electroplated bronze or brass layer to remove any roughness and discoloration using a loose buff made of several sections, and preferably a greaseless compound having a grain or grit size of about 200. It is preferred that the loose buff operate at a rotational speed of about 750 r.p.m. and have about a ten (10) inch outer diameter.

The deposition of a substantially moisture impervious clear coating according to step (j) entails depositing a clear coating of epoxy, resin, plastic, acrylic, etc. on the brass or bronze electroplate. It is preferred that the clear coating conform to the American National Standard For Materials and Finishes (ANSI/BHMA A156.18-1987) and the American National Standard For Bored and Preassembled Locks and Latches (ANSI/BHMA A156.2-1983). It is critical that the cure temperature of the clear coating is below that which would cause outgassing or leakout. Preferably, the clear coating is cured at a temperature below 400° F. In a preferred embodiment, the clear coating is an epoxy resin. As is well known in the art, an epoxy resin is a thermosetting resin based on the reactivity of the epoxide group. Preferably, the epoxy coating is No. 152C200 Clear Epoxy manufactured by the Powder Coatings Division of the Ferro Corporation of Cleveland, Ohio. No. 152C200 Clear Epoxy is a clear epoxy powder coating that has been formulated to give satisfactory hiding and coverage and to effect a tough, protective film with excellent resistance to corrosion. The aforementioned protective film has a smooth, glossy, lustrous finish that has a high degree of clarity. Preferably, the epoxy coating is electrostatically deposited in accordance with a twenty (20) minute cure schedule at a temperature of about 320° F. to effect a coating thickness between about 0.002 inch (2 mils) and 0.003 inch (3 mils), inclusive. The clear epoxy coating is substantially impervious to moisture penetration thereby substantially preventing atmospheric moisture from contacting the brass or bronze plating.

3. Bright Finish

In accordance with the present invention, a method is provided for creating a "bright" finish on a zinc die cast component which basically comprises the steps of: (a) polishing the component, (b) brightening the component surface, (c) removing residue resulting from step (b), (d) electroplating the component with copper, (e) buffing the copper layer, (f) removing residue resulting from step (e), (g) electroplating a brass or bronze layer over the copper layer, (h) buffing the brass or bronze electroplate, (i) removing residue resulting from step (h), (j) depositing a substantially moisture impervious clear coating to the component. The aforementioned steps will now be described in detail.

The polishing process of step (a) comprises six (6) steps. The first of these steps entails polishing the component to remove major defects, e.g. parting lines, etc. in the component surface. It is preferred that a #120 grit polishing belt having aluminum oxide abrasive and X-flex backing be utilized with a serrated rubber contact wheel. Preferably, the contact wheel has a hardness of about 70 durometers, about a fourteen (14) inch outer diameter and a rotational speed of about 1750 r.p.m. This first step effects a component surface texture; commensurate with a scratch pattern of about 120. The second step entails polishing the component in areas defined by intricate contours that are difficult to reach during the polishing process of the first step. Such intricate surface contours are typically found on door-lever handles. Preferably, a #150 grain or grit polishing belt having an aluminum oxide abrasive with X-flex backing is utilized in conjunction with a Bader polishing machine. Preferably, the Bader polishing machine utilizes a heavy-duty B.J.Y. attachment arm without a platen. This second step effects contoured portions of the component having a surface texture commensurate with a scratch pattern of about 150. The third step in the process entails repeating the second step, but using a #220 grain or grit size polishing belt in place of the #150 grain size polishing belt. This step this is a buffing or refining step which effects contoured portions of the component having a surface texture commensurate with a scratch pattern of about 220. The fourth step in the process entails polishing the component surface, except the contoured portions, with a #150 grain size polishing belt in order to transform the component surface texture from a scratch pattern of about 120, the result of the first step above, to a scratch pattern of about 150. Preferably, a #150 grit polishing belt having aluminum oxide abrasive and X-flex backing is used in conjunction with a diamond crosscut contact wheel having a rotational speed of about 1,750 r.p.m. and about a fourteen (14) inch outer diameter. Thus, as a result of the last two (2) steps, the surface texture of the contoured portions of the component is commensurate with a scratch pattern of about 220, and the remaining component surface texture is commensurate with a scratch pattern of about 150. The fifth step in the process repeats the fourth step. However, a #180 grain or grit size polishing belt is used in place of the #150 grain size polishing belt to transform the scratch pattern of 150 into a scratch pattern of about 180. This step effects a component surface texture commensurate with a scratch pattern of about 180. The sixth step in the process repeats the fifth step. However, a #220 grain size polishing belt is used in place of the #180 grain size polishing belt. Since the surface texture of a #220 grain size belt is very fine, the sixth step constitutes a buffing or refining step which includes motions to remove any sharp edges on the component surface. This step effects a component surface texture commensurate with a scratch pattern of about 220. Unlike the "satin" finish, a fine scratch pattern is desired for the "bright" finish. Finer scratch patterns are not as visible as coarse scratch patterns. 5 Furthermore, a surface texture commensurate with a scratch pattern of about 200 or about 220 facilitates subsequent buffing procedures. Although it is preferred to polish the component surface to attain a texture commensurate with a scratch pattern of about 220, the component surface may be polished to attain a texture commensurate with finer scratch patterns.

The brightening process of step (b) comprises two steps. The first step is a buffing process and entails removing the fine polishing scratch pattern resulting from the #220 grain size polishing belt. A loose buff made of several sections is used in conjunction with a cut-down compound. A cut-down compound is an abrasive material in block form. Typically, the block is comprised of animal fats which provide 1,5 sufficient lubrication to allow movement of the base metal substrate material to fill in crevices and voids in the substrate surface. Preferably, the loose buff has a rotational speed of about 1,750 r.p.m. and about a twelve (12) inch outer diameter. The second step entails brightening the surface of the component to a mirror-like luster. Preferably, a loose buff comprised of several sections is used in conjunction with a color compound. Preferably, the loose buff has a rotational speed of about 1750 r.p.m. and about a 12 (twelve) inch outer diameter.

The degreasing process of step (c) above entails removing any residue left on the component resulting from the brightening process of step (b). Preferably, a solvent such as trichloroethylene is utilized in a vapor degreaser to remove the residue.

The copper electroplating step (d) is an electroplating process that comprises the following steps: (i) making the zinc-die cast component cathodic, (ii) applying an electrolytic cleaner to the zinc-die cast component, (iii) rinsing the component in cold water flowing in a first direction, (iv) rinsing the component in cold water flowing in a second direction which is counter to the first direction, (v) dipping the component in an acid bath, (vi) rinsing the component in cold water flowing in first direction, (vii) rinsing the component in cold water flowing a second direction which is counter to the first direction, (viii) striking the component with potassium copper cyanide, (ix) plating the component with copper, (x) treating the component to remove any residue cyanide, (xi) rinsing the component in cold water, (xii) rinsing in component in hot water, and (xi ii) drying the component with a hot air dryer.

Step (e) entails buffing the electroplated copper deposit by removing any roughness and any non-adherent copper film left on the surface of the component, and brightening the copper plate surface to a mirror-like luster. Preferably, a loose buff made of several sections is utilized in conjunction with a color compound. Preferably, the loose buff has a rotational speed of about 750 r.p.m. and about a (10) inch outer diameter.

The degreasing process of step (f) entails removing any color compound residue, resulting from step (e), on the copper plated surface. In order to effect the removal of the residue, it is preferred that the component be submerged in a solvent such as trichloroethylene.

If it is desired to electroplate the component with brass, then step (g) comprises the steps of: (i) applying an electrolytic cleaner, (ii) rinsing the component in cold water, (iii) dipping the component in an acid bath, (iv) rinsing the component in cold water, (v) striking the component with copper to form a copper plate, (vi) removing cyanide residue, (vii) rinsing the component in cold water, (viii) dipping the component in an acid bath, (ix) rinsing the component with cold water, (x) electroplating the component with nickel, (xi) performing a nickel "dragout" process on the nickel plate, (xii) rinsing the component with cold water, (xiii) dipping the component in an acid bath, (xiv) rinsing the component with cold water, (xv) electroplating the component with brass, (xvi) removing cyanide residue, (xvii) rinsing the component in cold water, (xviii) dipping the component in acid, (xix) rinsing the component in cold water, (xx) dipping the component in a chromate bath, (xxi) removing the chrome residue, (xxii) rinsing the component in cold water, and (xxiii) rinsing the component in hot water.

If it desired to electroplate the component with bronze, then step (g) comprises the steps of: (i) applying an electrolytic cleaner to the component, (ii) rinsing the component with cold water, (iii) clipping the component in acid, (iv) rinsing the component in cold water, (v) striking the component with copper, (vi) electroplating the component with bronze, (vii) removing cyanide residue, (viii) rinsing the component in cold water, (ix) dipping the component in a chromate bath, (x) removing chrome residue, (xi) rinsing the component in cold water, (xii) rinsing the component in hot water and (xiii) drying component in hot air dryer.

Although it is preferred to electroplate a brass or bronze layer over the copper plating or base layer described in step (d) above, step (g) may be implemented by plating any copper alloy over the copper plating or base layer.

Step (h) above entails buffing and brightening the surface of the brass or bronze electroplate using a color buffing compound. Such compounds are well known in the art and are not described in detail herein.

Step (i) is a degreasing process and entails removing any color buffing residue on the surface of the brass or bronze electroplated deposit. This step is preferably implemented by applying a solvent, such as trichloroethylene in a vapor degreaser, to the surface of the plated component.

Step (j) entails depositing a substantially moisture impervious clear coating on the bronze or brass plating. The coating has the features described above in step (j) of the "satin finish" process.

Polishing the substrate surface until the texture is commensurate with the aforementioned specified scratch patterns in the "satin" and "bright" finishing processes are necessary to (i) shift the substrate material to fill in voids, crevices or pores in the substrate surface to substantially prevent entrapment of atmospheric gases (ii) significantly improve the adhesion to the subsequent copper plate and (iii) produces a copper plate having a substantially uniform surface which significantly improves the adhesion between the copper plate and the brass or bronze layer. The copper plate functions as a barrier to atmospheric gases entrapped in any remaining pores in the substrate surface. The copper plate further functions as a base layer which provides a surface having substantially uniform texture upon which the brass or bronze layer may be deposited. The cyanide waste treatment processes substantially eliminates cyanide entrapped in any pores in the copper layer. The substantially moisture impervious clear coating prevents atmospheric moisture from contacting the brass or bronze layer. Thus, the present invention efficiently attains the objects set forth above and those objects made apparent from the preceding description.

While the invention has been described in what are considered to be the most practical and preferred embodiments, it will be recognized that many variations are possible and come within the scope thereof. For instance, although it is preferred to plate a brass or bronze layer over the electroplated copper layer, any copper alloy may be plated over the copper layer. Therefore, the appended claims are entitled to a full range of equivalents.

Thus, having described the invention, what is claimed is:

1. A finishing process for a zinc die casting which inhibits the occurrence of leakout and outgassing, consisting essentially of the steps of:

(a) polishing the surface of the zinc die casting;

(b) electroplating the zinc die casting with copper;

(c) polishing the copper electroplated zinc die casting;

(d) electroplating a layer of metal over said polished copper; and (e) depositing a substantially moisture impervious coating on said metal layer.

2. The process of claim 1 wherein step (a) comprises the steps of polishing the surface of the zinc die casting until the surface is commensurate with a scratch pattern of at least 150.

3. The process of claim 2 further including the steps of:

(a) prior to the step of electroplating the zinc die casting with copper, applying a greaseless compound to the zinc die casting having a grain size of at least 200; and (b) thereafter buffing the zinc die casting.

4. The process of claim 3 further including the steps of:

(a) after electroplating said zinc die casting with copper, applying a greaseless compound to the surface of the copper electroplate having a grain size of at least 200; and (b) thereafter buffing the surface of the copper electroplate.

5. The process of claim 4 further including the steps of:

(a) after said metal layer is electroplated over said copper, applying a greaseless compound to the surface of said metal layer having a grain size of at least 200; and (b) buffing the surface of said metal layer to remove discoloration in the surface of said metal layer.

6. A product made from the process of claim 5.

7. The process of claim 2 further including the steps of polishing the surface of the zinc die casting until the surface is commensurate with a scratch pattern of at least 220.

8. The process of claim 7 further including the steps of:

(a) applying a cut-down compound to the surface of the zinc die casting; and (b) thereafter buffing the surface of the zinc die casting.

9. The process of claim 8 further including the step of degreasing the surface of the zinc die casting.

10. The process of claim 9 further including:

(a) applying a color buffing compound to the electroplated copper; and (b) thereafter buffing the copper.

11. The process of claim 10 further including, after said buffing step (b), the step of degreasing the copper electroplate.

12. The process of claim 11 further including the steps of:

(a) applying a color buffing compound to the metal layer; and (b) thereafter buffing the metal layer.

13. The process of claim 12 further including, after said buffing step (b), the step of degreasing the metal layer.

14. A product made from the process of claim 13.

15. The process of claim 1 wherein the metal layer is a copper alloy selected from the group consisting of brass and bronze.

16. The process of claim 1 wherein the moisture impervious clear coating is an epoxy resin.

17. The process of claim 1 wherein the substantially moisture impervious coating is electrostatically deposited.

18. The process of claim 17 wherein the impervious coating is a clear coating of epoxy.

19. A product made from the process of claim 18.

20. The process of claim 1 wherein the substrate is electroplated with copper using a cyanide copper electroplating bath.

21. The process of claim 20 wherein the electroplated copper is treated to remove cyanide plating residues before electroplating the layer of metal over said polished copper.

22. A product made from the process of claim 21.

23. A product made from the process of claim 20.

* * * * *